US011289004B2

(12) United States Patent
Ma et al.

(10) Patent No.: US 11,289,004 B2
(45) Date of Patent: Mar. 29, 2022

(54) PIXEL DRIVING CIRCUIT, ORGANIC LIGHT EMITTING DISPLAY PANEL AND PIXEL DRIVING METHOD

(71) Applicants: HEFEI BOE OPTOELECTRONICS TECHNOLOGY CO., LTD., Anhui (CN); BOE TECHNOLOGY GROUP CO., LTD., Beijing (CN)

(72) Inventors: Juncai Ma, Beijing (CN); Dandan Li, Beijing (CN); Lisen Wang, Beijing (CN)

(73) Assignees: HEFEI BOE OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 618 days.

(21) Appl. No.: 16/327,629

(22) PCT Filed: Sep. 5, 2018

(86) PCT No.: PCT/CN2018/104197
§ 371 (c)(1),
(2) Date: Feb. 22, 2019

(87) PCT Pub. No.: WO2019/109690
PCT Pub. Date: Jun. 13, 2019

(65) Prior Publication Data

US 2021/0358380 A1 Nov. 18, 2021

(30) Foreign Application Priority Data

Dec. 8, 2017 (CN) ..... 201711292875.3

(51) Int. Cl.
*G09G 3/3258* (2016.01)
*G09G 3/20* (2006.01)
(Continued)

(52) U.S. Cl.
CPC ..... *G09G 3/2092* (2013.01); *G09G 3/3266* (2013.01); *G09G 3/3291* (2013.01);
(Continued)

(58) Field of Classification Search
CPC .. G09G 3/2092; G09G 3/3208; G09G 3/3233; G09G 3/3258; G09G 3/3266;
(Continued)

(56) References Cited

U.S. PATENT DOCUMENTS 6,858,989 B2 2/2005 Howard
7,317,400 B2 * 1/2008 Sato ..... G09G 3/006 324/500
(Continued)

FOREIGN PATENT DOCUMENTS

CN 102122490 A 7/2011
CN 202838917 U 3/2013
(Continued)

OTHER PUBLICATIONS

International Search Report and Written Opinion dated Nov. 28, 2018; PCT/CN2018/104197.

*Primary Examiner* — Michael J Eurice

(57) ABSTRACT

A pixel driving circuit, an organic light emitting display panel and a pixel driving method. The pixel driving circuit includes: a switching sub-circuit, a driving sub-circuit, a storage capacitor and a charge eliminating sub-circuit; the charge eliminating sub-circuit has a control terminal connected to a first scanning signal line, and other terminals connected to the first terminal of the driving sub-circuit, a cathode of the organic light emitting element (OLED) and a reference voltage terminal respectively, and can enable a potential between the anode and the cathode of the organic light emitting element to be reversed under control of the first scanning signal line.

18 Claims, 4 Drawing Sheets

(51) Int. Cl.
*G09G 3/3266* (2016.01)
*G09G 3/3291* (2016.01)
*G09G 3/3233* (2016.01)

(52) U.S. Cl.
CPC ... *G09G 3/3233* (2013.01); *G09G 2300/0842* (2013.01); *G09G 2310/061* (2013.01); *G09G 2310/08* (2013.01); *G09G 2320/0233* (2013.01); *G09G 2320/043* (2013.01)

(58) Field of Classification Search
CPC ..... G09G 3/3291; G09G 2300/0819; G09G 2300/0842; G09G 2300/0866; G09G 2310/0256; G09G 2310/061; G09G 2310/08; G09G 2320/02; G09G 2320/0233; G09G 2320/043; G09G 2320/045
See application file for complete search history.

(56) References Cited

U.S. PATENT DOCUMENTS 9,207,851 B1* 12/2015 Han ..... G06F 3/0488
10,319,292 B2 6/2019 Wang et al.
2002/0036626 A1* 3/2002 Tsutsui ..... G09G 3/3659 345/204
2003/0234758 A1* 12/2003 Bu ..... G09G 3/3648 345/90
2005/0140596 A1* 6/2005 Lee ..... G09G 3/3233 345/76
2005/0168490 A1* 8/2005 Takahara ..... G09G 3/2014 345/690
2008/0111812 A1* 5/2008 Shirasaki ..... G09G 3/3233 345/212
2008/0180365 A1* 7/2008 Ozaki ..... G09G 3/3233 345/76
2008/0238953 A1* 10/2008 Ogura ..... G09G 3/3275 345/697
2009/0002282 A1* 1/2009 Tomida ..... G09G 3/3275 345/76
2009/0109158 A1* 4/2009 Shirai ..... G09G 3/3688 345/94
2009/0135111 A1* 5/2009 Yamamoto ..... H01L 27/3272 345/76
2009/0295423 A1* 12/2009 Levey ..... G09G 3/006 324/760.01
2010/0045646 A1* 2/2010 Kishi ..... G09G 3/3291 345/211
2010/0091006 A1* 4/2010 Yoo ..... G09G 3/3233 345/213
2011/0025678 A1* 2/2011 Chung ..... G09G 3/3233 345/213
2011/0050741 A1* 3/2011 Jeong ..... G09G 3/3291 345/690
2012/0105404 A1* 5/2012 Gotoh ..... G06F 3/0412 345/207
2012/0313923 A1* 12/2012 Minami ..... G09G 3/3233 345/212
2013/0002641 A1* 1/2013 Kim ..... G09G 3/3685 345/212
2013/0050292 A1* 2/2013 Mizukoshi ..... G09G 3/3291 345/690
2013/0057530 A1* 3/2013 Han ..... G09G 3/3696 345/211
2013/0169699 A1* 7/2013 Jeong ..... G09G 3/3233 345/690
2014/0160185 A1* 6/2014 Okuno ..... G09G 3/3283 345/691
2014/0168195 A1* 6/2014 Kumeta ..... G09G 3/3233 345/212
2014/0354285 A1* 12/2014 Kim ..... G09G 3/3233 324/414
2015/0123953 A1* 5/2015 Shim ..... G09G 3/3233 345/205
2015/0129903 A1* 5/2015 Yamamoto ..... G09G 3/3233 257/88
2015/0187268 A1* 7/2015 Tani ..... G09G 3/3233 345/77
2015/0188431 A1* 7/2015 Cho ..... G09G 3/2003 345/212
2015/0294626 A1* 10/2015 Bi ..... G09G 3/3233 345/211
2016/0012799 A1* 1/2016 Kim ..... G09G 3/3208 345/205
2016/0062522 A1* 3/2016 Yang ..... G09G 3/3291 345/174
2016/0062548 A1* 3/2016 Kwon ..... G06F 3/042 345/173
2016/0103513 A1* 4/2016 Yang ..... G06F 3/042 345/175
2016/0125811 A1* 5/2016 Park ..... G09G 3/3258 345/694
2016/0189612 A1* 6/2016 Lee ..... G09G 3/2003 345/690
2016/0343278 A1* 11/2016 Tsujita ..... G09G 3/3233
2016/0351095 A1* 12/2016 Tani ..... G09G 3/3283
2017/0025061 A1* 1/2017 Takizawa ..... G09G 3/3291
2017/0039941 A1* 2/2017 Wu ..... G09G 3/32
2017/0110052 A1* 4/2017 Kuo ..... G09G 3/30
2017/0140704 A1* 5/2017 Cai ..... H01L 27/3262
2018/0061292 A1* 3/2018 Hong ..... G09G 3/006
2018/0137825 A1* 5/2018 An ..... G11C 19/28
2018/0275795 A1* 9/2018 Takahashi ..... G06F 3/047
2019/0121476 A1* 4/2019 Jang ..... G06F 3/0412

FOREIGN PATENT DOCUMENTS

CN 105047138 A 11/2015
CN 107833559 A 3/2018

* cited by examiner

PIXEL DRIVING CIRCUIT, ORGANIC LIGHT EMITTING DISPLAY PANEL AND PIXEL DRIVING METHOD

This application claims the priority of Chinese Patent Application No. 201711292875.3, filed on Dec. 8, 2017, which is hereby incorporated by reference in its entirety as a part of this application.

TECHNICAL FIELD

The present disclosure relates to the field of display technology, and more particularly to a pixel driving circuit, an organic light emitting display panel and a pixel driving method.

BACKGROUND

An organic light emitting diode (OLED in short) is an active light emitting device whose structure is similar to a "sandwich structure". Structure of the OELD illustrated in FIG. 1 comprises multiple layers of film, including an anode 11, a hole injection layer 12, a hole transport layer 13, an organic light emitting layer 14, an electron transport layer 15, an electron injection layer 16, a cathode 17, etc., disposed on a base substrate 10.

A voltage is applied between the anode 11 and the cathode 17 to control the OLED to emit light; in the structure of the OLED, interfaces exist between the hole transport layer 13 and the organic light emitting layer 14 and between the organic light emitting layer 14 and the electron transport layer 15, and holes (holes carrying positive charges) that have not entered the organic light emitting layer 14 are gathered at the interface between the hole transport layer 13 and the organic light emitting layer 14, electrons (electrons carrying negative charges) that have not entered the organic light emitting layer 14 are gathered at the interface between the organic light emitting layer 14 and the electron transport layer 15; such electrons or holes will block other electrons or holes from entering the organic light emitting layer 14. As the OLED emits light over time, more and more electrons or holes will be gathered at the interfaces, and the gathered electrons and holes form a built-in electric field on two sides of the organic light emitting layer 14, which hinders recombination of the electrons and the holes, affects luminous efficiency of the OLED, reduces brightness of the OLED, and lowers life span of the OLED.

SUMMARY

The present disclosure provides a pixel driving circuit, an organic light emitting display panel and a pixel driving method.

According to an embodiment of the present disclosure, there is provided a pixel driving circuit, comprising:

a switching sub-circuit having a control terminal connected to a first scanning signal line, a first terminal connected to a data signal line, and a second terminal connected to a control terminal of a driving sub-circuit, and configured to write a data voltage outputted by the data signal line;

the driving sub-circuit having a first terminal connected to a power supply voltage terminal and a second terminal connected to an anode of an organic light emitting element, and configured to drive the organic light emitting element to emit light under control of the switching sub-circuit;

a storage capacitor having one terminal connected to the control terminal of the driving sub-circuit and the other terminal connected to the first terminal of the driving sub-circuit, and configured to store the data voltage outputted by the data signal line; and a charge eliminating sub-circuit having a control terminal connected to a second scanning signal line, and other terminals connected to the first terminal of the driving sub-circuit, a cathode of the organic light emitting element and a reference voltage terminal respectively, and configured to enable a potential between the anode and the cathode of the organic light emitting element to be reversed under control of the second scanning signal line.

According to an embodiment of the present disclosure, the pixel circuit further comprises:

a gate voltage resetting sub-circuit having a control terminal connected to a third scanning signal line, and other terminals connected to the cathode of the organic light emitting element, the control terminal of the driving sub-circuit and the reference voltage terminal respectively, and configured to reset a gate voltage of the driving sub-circuit under control of the third scanning signal line.

According to an embodiment of the present disclosure, the first scanning signal line is a scanning signal line for a present row, the second scanning signal line and the third scanning signal line are both a scanning signal line for a previous row.

According to an embodiment of the present disclosure, the switching sub-circuit comprises a first transistor, wherein a gate of the first transistor serves as the control terminal of the switching sub-circuit, a first electrode of the first transistor serves as the first terminal of the switching sub-circuit, and a second electrode of the first transistor serves as the second terminal of the switching sub-circuit.

Optimally, the driving sub-circuit comprises a second transistor, wherein a gate of the second transistor serves as the control terminal of the driving sub-circuit, a first electrode of the second transistor serves as the first terminal the driving sub-circuit, and a second electrode of the second transistor serves as the second terminal of the driving sub-circuit.

Optionally, the charge eliminating sub-circuit comprises a third transistor and a fourth transistor, wherein a gate of the third transistor and a gate of the fourth transistor serve as the control terminal of the charge eliminating sub-circuit, and are connected to the second scanning signal line;

a first electrode of the third transistor is connected to the first electrode of the second transistor, and a second electrode of the third transistor is connected to the cathode of the organic light emitting element;

a first electrode of the fourth transistor is connected to the cathode of the organic light emitting element, and a second electrode of the fourth transistor is connected to the reference voltage terminal.

Optionally, the gate voltage resetting sub-circuit comprises a fifth transistor and a sixth transistor;

wherein a gate of the sixth transistor serves as the control terminal of the gate voltage resetting sub-circuit, a first electrode of the sixth transistor is connected to the cathode of the organic light emitting element, and a second electrode of the sixth transistor is connected to a gate of the fifth transistor;

a first electrode of the fifth transistor is connected to the gate of the second transistor, and a second electrode of the fifth transistor is connected to the reference voltage terminal.

According to an embodiment of the present disclosure, one of the third transistor and the fourth transistor is an N-type transistor, and the other of the third transistor and the fourth transistor is a P-type transistor.

According to an embodiment of the present disclosure, the fifth transistor and the sixth transistor are both N-type transistors or both P-type transistors.

According to an embodiment of the present disclosure, there is provided an organic light emitting display panel, comprising a plurality of pixel cells, a plurality of scanning signal lines and a plurality of data signal lines, wherein the respective pixel cells are arranged in areas defined by intersection of the scanning signal lines and the data signal lines, each pixel cell includes an organic light emitting element and any of the pixel driving circuit as described above.

According to an embodiment of the present disclosure, there is provided a pixel circuit driving method applied to any of the pixel driving circuit as described above, the driving method comprising:

controlling, through the scanning signal inputted from the second scanning signal line, the charge eliminating sub-circuit to reverse the potential between the anode and the cathode of the organic light emitting element; and controlling, through the first scanning signal line, the switching sub-circuit to write the data voltage outputted from the data signal line to the storage capacitor for storage, and controlling, by the driving sub-circuit, the organic light emitting element to emit light.

According to an embodiment of the present disclosure, the driving method further comprises:

controlling, through the third scanning signal line, the gate voltage resetting sub-circuit to reset the gate voltage of the driving sub-circuit.

It is known from the above embodiments that, the pixel driving circuit writes the data voltage outputted from the data signal line through the switching sub-circuit, further converts the data voltage into a current signal through the driving sub-circuit, and drives the organic light emitting element to emit light through the driving sub-circuit, and due to the presence of the storage capacitor, the data voltage written by the switching sub-circuit can be stored, thus maintaining the organic light emitting element to continuously emit light in a display period.

The charge eliminating sub-circuit reverses the potential between the anode and the cathode of the organic light emitting element under control of the second scanning signal line; after the potential is reversed, due to the reverse electric field between the anode and the cathode of the organic light emitting element, electrons gathered at the interface between the electron transport layer and the organic light emitting layer return to the electron transport layer, and the holes gathered at the interface between the hole transport layer and the organic light emitting layer return to the hole transport layer, thereby eliminating most of the electrons and holes at the interfaces, avoiding gathering and accumulation of the holes and the electrons at the aforesaid two interface locations.

The above general description and the following detailed description are intended to be merely exemplary and illustrative, and should not be construed as limiting the present disclosure.

BRIEF DESCRIPTION OF THE DRAWINGS

In order to more clearly illustrate the technical solutions in the embodiments of the present disclosure, drawings necessary for describing the embodiments will be briefly introduced below, obviously, the below described drawings are only related to some embodiments of the present disclosure and thus are not limitative of the present disclosure.

DETAILED DESCRIPTION OF THE EMBODIMENTS

Figure 1:
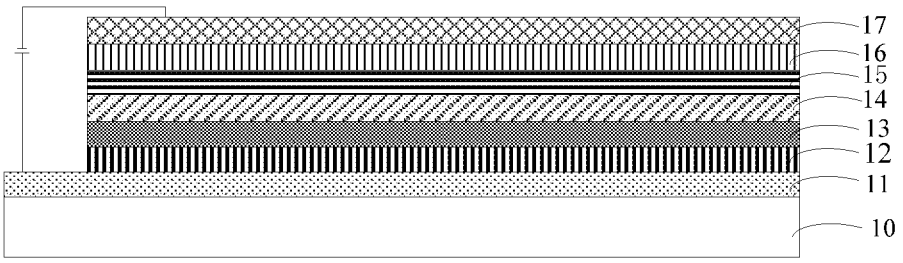
FIG. 1 is a schematic structural diagram of a known OLED device.

Exemplary embodiments will be described in detail herein, wherein the examples are illustrated in the accompanying drawings. When the description below relates to figures, unless otherwise indicates, the same reference numeral in different figures represents same or like elements. The examples described in exemplary embodiments below do not represent all embodiments in conformity with the present disclosure. On the contrary, they are merely examples of the device and method in conformity with some aspects of the present disclosure as defined in the accompanying claims.

Figure 2:
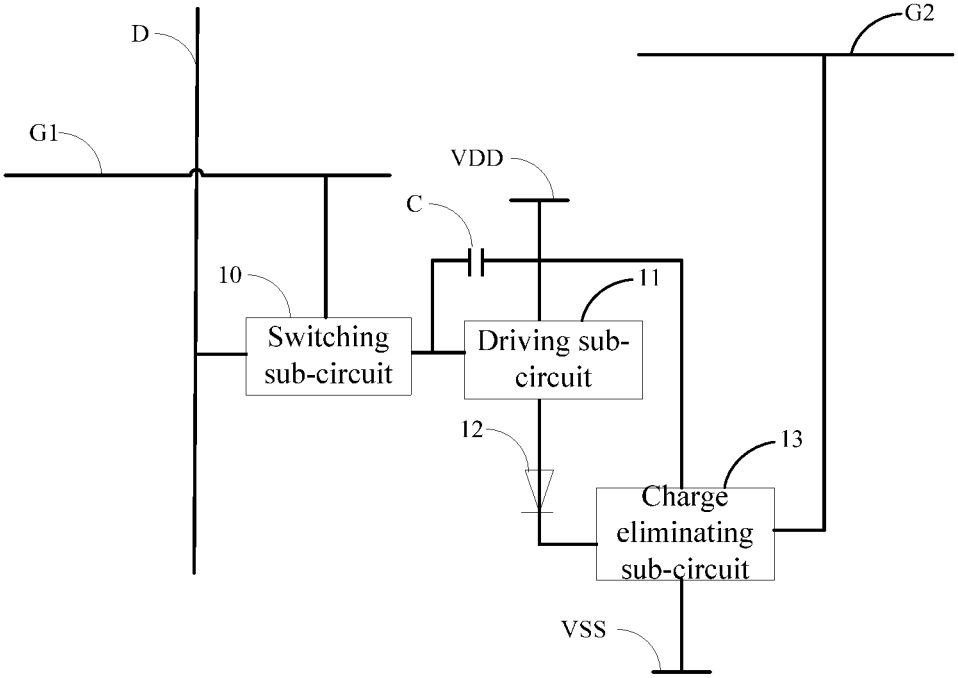
FIG. 2 is a schematic structural diagram of a pixel driving circuit according to an embodiment of the present disclosure.

An embodiment of the present disclosure provides a pixel driving circuit, which can address the issue that the existing organic light emitting diode OLED has low luminous efficiency and short life span. As illustrated in FIG. 2, the circuit comprises:

a switching sub-circuit 10 having a control terminal connected to a first scanning signal line G1, a first terminal connected to a data signal line D, and a second terminal connected to a control terminal of a driving sub-circuit 11, and configured to write a data voltage outputted by the data signal line D;

the driving sub-circuit 11 having a first terminal connected to a power supply voltage terminal VDD and a second terminal connected to an anode of an organic light emitting element 12, and configured to drive the organic light emitting element 12 to emit light under control of the switching sub-circuit 10;

a storage capacitor C having one terminal connected to the control terminal of the driving sub-circuit 11 and the other terminal connected to the first terminal of the driving sub-circuit 11, and configured to store the data voltage outputted by the data signal line D; and a charge eliminating sub-circuit 13 having a control terminal connected to a second scanning signal line G2, and other terminals connected to the first terminal of the driving sub-circuit 11, a cathode of the organic light emitting element 12 and a reference voltage terminal VSS respectively, and configured to enable a potential between the anode and the cathode of the organic light emitting element 12 to be reversed under control of the second scanning signal line G2.

The above organic light emitting element can be an organic light emitting diode OLED or other light emitting device that emits light through electrons and holes exciting the light emitting layer.

The pixel driving circuit of the embodiment writes the data voltage outputted by the data signal line through the switching sub-circuit, further converts the data voltage into a current signal through the driving sub-circuit, drives the organic light emitting element to emit light through the driving sub-circuit, and due to presentence of the storage capacitor, the data voltage written by the switching sub-circuit can be stored, thus maintaining the organic light emitting element to continuously emit light in a display period thereof.

The charge eliminating sub-circuit reverses the potential between the anode and the cathode of the organic light emitting element under control of the second scanning signal line, wherein the potential reversion refers to that an electric field formed between the anode and the cathode of the organic light emitting element has an opposite direction to an electric field formed when the organic light emitting element emits light. For example, when the organic light emitting element emits light, the potential at the anode is higher than the potential at the cathode, and the direction of the electric field at this time is from the anode to the cathode, and after the potential is reversed, the potential at the anode is lower than the potential at the cathode, the direction of the electric field at this time is from the cathode to the anode.

After the potential is reversed, due to the reverse electric field between the anode and the cathode of the organic light emitting element, the electrons accumulated at the interface between the electron transport layer and the organic light emitting layer return to the electron transport layer, and the holes accumulated at the interface between the hole transport layer and the organic light emitting layers return to the hole transport layer, thereby eliminating most of the electrons and holes at the interfaces, avoiding gathering and accumulation of holes and electrons at the aforesaid two interface locations, thereby addressing the issue of the rapid reduction of luminous efficiency resulted from the organic light emitting element being driven to emit light for a long time, enhancing the luminous efficiency, and increasing the life span of the organic light emitting element.

Figure 3:
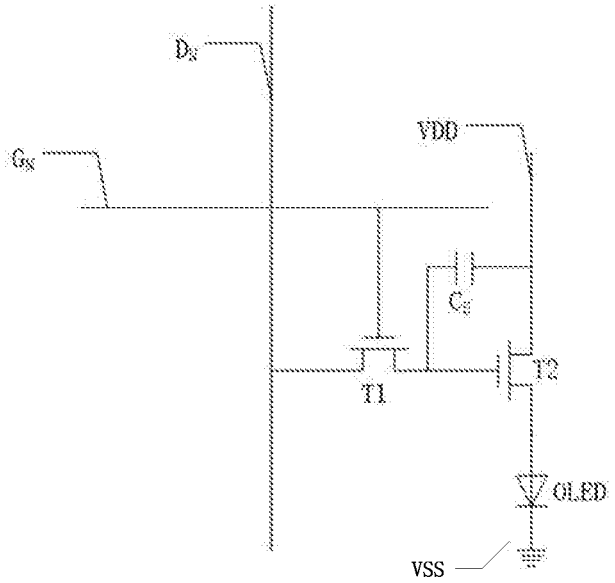
FIG. 3 is a schematic structural diagram of a known pixel driving circuit.

The existing pixel driving circuit is usually 2T1C, that is, a structure of two thin film transistors plus one capacitor, and FIG. 3 illustrates a 2T1C pixel driving circuit structure, including a first transistor T1, a second transistor T2 and a capacitor $C_S$, wherein the first transistor T1 is a switching transistor, the second transistor T2 is a driving transistor, and the capacitor $C_S$ is a storage capacitor.

For example, the gate of the first transistor T1 is connected to the scanning signal line $G_N$ for inputting a row scanning signal, the source of the first transistor T1 is connected to the data signal line $D_N$ for inputting a data signal, the drain of the first transistor T1 is connected to the gate of the second transistor T2 and one terminal of the capacitor $C_S$; the source of the second transistor T2 is connected to the power supply voltage terminal VDD, the drain of the second transistor T2 is electrically connected to the anode of the OLED, and the cathode of the OLED is connected to the reference voltage terminal; one terminal of the capacitor $C_S$ is connected to the drain of the first thin film transistor T1, and the other terminal of the capacitor $C_S$ is connected to the source of the second transistor T2.

The above pixel driving circuit includes two operating periods within each frame time period, and the specific operating process comprises:

the first period, a data voltage $V_{data}$ writing period t1; during this period, for example, a high potential scanning signal is inputted through the scanning signal line so as to control the first transistor T1 to be turned on, and the data voltage $V_{data}$ of the data signal outputted from the data signal line is applied to the gate of the second transistor T2 and the capacitor $C_S$ via the first transistor T1, the data voltage $V_{data}$ is written to the storage capacitor $C_S$; meanwhile the data signal acts on the gate of the second transistor T2, the second transistor T2 is turned on, and the driving current outputted through the second transistor T2 drives the OLED to emit light;

the second period, a display maintaining period t2; during this period, the scanning signal line outputs a low potential signal, the gate of the first transistor T1 is at a low potential, and the first transistor T1 is turned off; due to the storage function of the capacitor $C_S$, the gate voltage of the second transistor T2 can be still maintained at the level of the data voltage $V_{data}$, so that the second transistor T2 is in a turned-on state; the driving current is applied to the OLED via the second transistor T2, thus driving the OLED to emit light, until a high potential scanning signal in a next frame arrives, and then the first transistor T1 is turned on again.

As for the driving transistor T2 in the pixel driving circuit of 2T1C described above, its gate potential is biased in a fixed direction all the while, and the threshold voltage Vth of the driving transistor gradually rises; since the driving current of the OLED $loled=K*(Vgs-Vth)^2$, as the threshold voltage Vth increases, the driving current of the OLED gradually reduces, and reduction of the driving current causes the luminous efficiency of the OLED to decrease.

Figure 4:
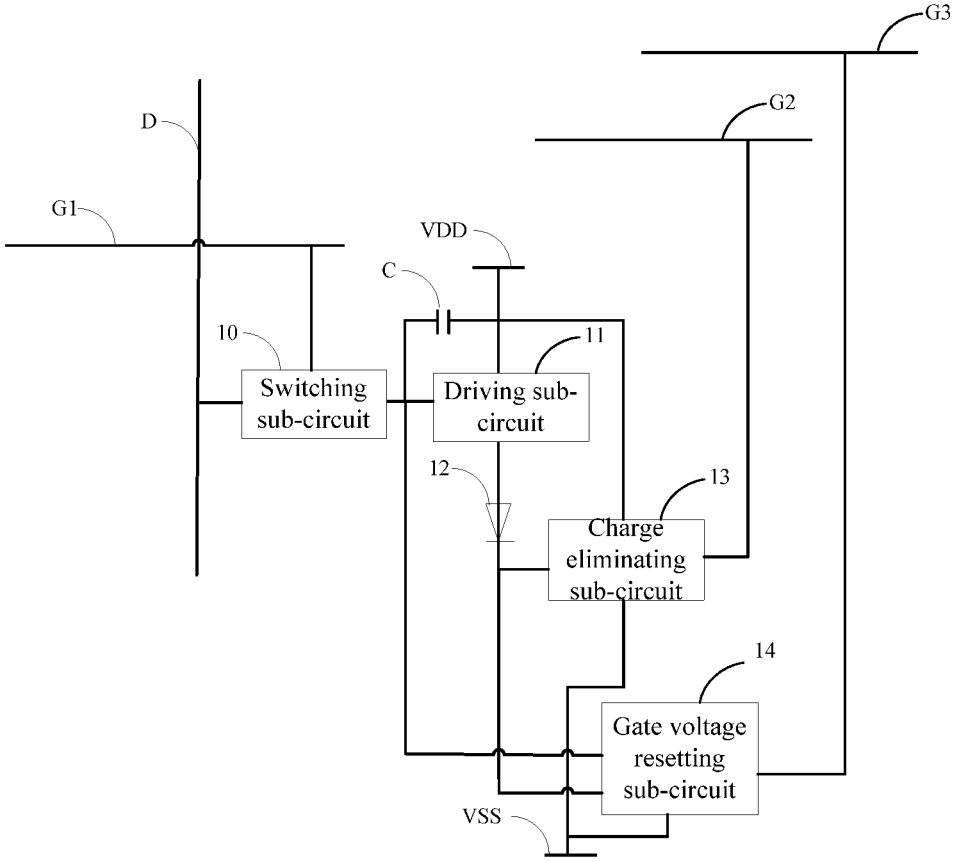
FIG. 4 is a schematic structural diagram of a pixel driving circuit according to another embodiment of the present disclosure.

For the issue of the gate potential bias of the driving transistor mentioned above, as illustrated in FIG. 4, the pixel driving circuit according to an embodiment of the present disclosure can, on the basis of FIG. 2, further comprise:

a gate voltage resetting sub-circuit 14 having a control terminal connected to a third scanning signal line G3, and other terminals connected to the cathode of the organic light emitting element 12, the control terminal of the driving sub-circuit 11 and the reference voltage terminal VSS respectively, and configured to reset a gate voltage of the driving sub-circuit 11 under control of the third scanning signal line G3.

In this embodiment, under control of the third scanning signal line, the gate voltage of the driving sub-circuit is reset by the gate voltage resetting sub-circuit, so that the gate voltage of the driving sub-circuit is not biased in a fixed direction, thereby addressing the issue that the threshold voltage Vth of the driving sub-circuit gradually rises, and eliminating the drift issue of the threshold voltage Vth, improving the stability of the driving current of the OLED, making luminance of the OLED uniform, and enhancing the display effect of the display image of the OLED display device using the pixel driving circuit.

In an embodiment, the first scanning signal line refers to a scanning signal line for a present row, both the second scanning signal line and the third scanning signal line refer to the scanning signal line for a previous row.

In a display panel using an organic light emitting element, pixel cells distributed in matrix are generally included, and a plurality of scanning signal lines and a plurality of data signal lines are included, and areas defined by intersections of the scanning signal lines and the data signal lines constitute respective pixel cells, each of the pixel cells includes an organic light emitting element and a pixel driving circuit. The plurality of pixel cells in the same row are connected to a corresponding scanning signal line, and the plurality of pixel cells in the same column are connected to a corresponding data signal line; a scanning manner is adopted when a picture is displayed on the display panel, for example, the scanning signal is inputted to the scanning signal line of each row in sequence from top to bottom, at the same time, the data signal is inputted to the data signal line of each column in sequence from left to right; the scanning time for one frame of picture is the scanning time for completing scanning of the scanning signal lines of all the rows, that is, the scanning time for completing all the data signal lines.

The scanning signal line of the present row refers to a scanning signal line connected to the pixel driving circuit in the present pixel cell, and the data signal line refers to a data signal line for a present row connected to the pixel driving circuit in the present pixel cell.

For example, both the second scanning signal line and the third scanning signal line refer to a same scanning signal line, both of which are the scanning signal line for the previous row, and the scanning signal line for the previous row is used to control the operating states of the charge eliminating sub-circuit and the gate voltage resetting sub-circuit. While using the scanning signal outputted by the scanning signal line for the previous row to supply the scanning signal to respective pixel driving circuits of the previous row, the potential of the anode and the cathode of the organic light emitting element in the pixel driving circuit of the present row is reversed and the gate voltage of the driving sub-circuit in the pixel driving circuit of the present row is reset; as such, potential reverse and gate voltage resetting can be carried out at an interval of the scanning time for each frame of picture as a fixed period, which can periodically eliminate gathering and accumulation of holes and electrons at the two interface locations, thereby increasing luminous efficiency of the organic light emitting element and improving display effect of the image, without requiring a separately disposed scanning signal line, which can simplify the control mode of the pixel driving circuit, and can reduce the number of the scanning signal lines and increase the aperture ratio of the display device.

The second scanning signal line and the third scanning signal line mentioned above can also be scanning signal lines that control the operating states of the charge eliminating sub-circuit and the gate voltage resetting sub-circuit respectively, or each of the first scanning signal line, the second scanning signal line and the third scanning signal line is the scanning signal line of the present row, or the first scanning signal line is the scanning signal line of the present row, the second scanning signal line and the third scanning signal line are scanning signal lines of the other rows, the present disclosure makes no limitations thereto.

It should be noted that, if each of the first scanning signal line, the second scanning signal line and the third scanning signal line is the scanning signal line of the present row, the pixel driving circuit can be controlled to operate by inputting the scanning signal in a manner of time-division, for example, in the first period, the charge eliminating sub-circuit and the gate voltage resetting sub-circuit are controlled by the scanning signal outputted by the scanning signal line of the present row to operate so as to reverse the potential of anode and cathode of the organic light emitting element and reset the gate voltage of the driving sub-circuit; in the second period, the switching sub-circuit and the driving sub-circuit are controlled by the scanning signal outputted by the scanning signal line of the present row to operate so as to cause the organic light emitting element to emit light.

Figure 5:
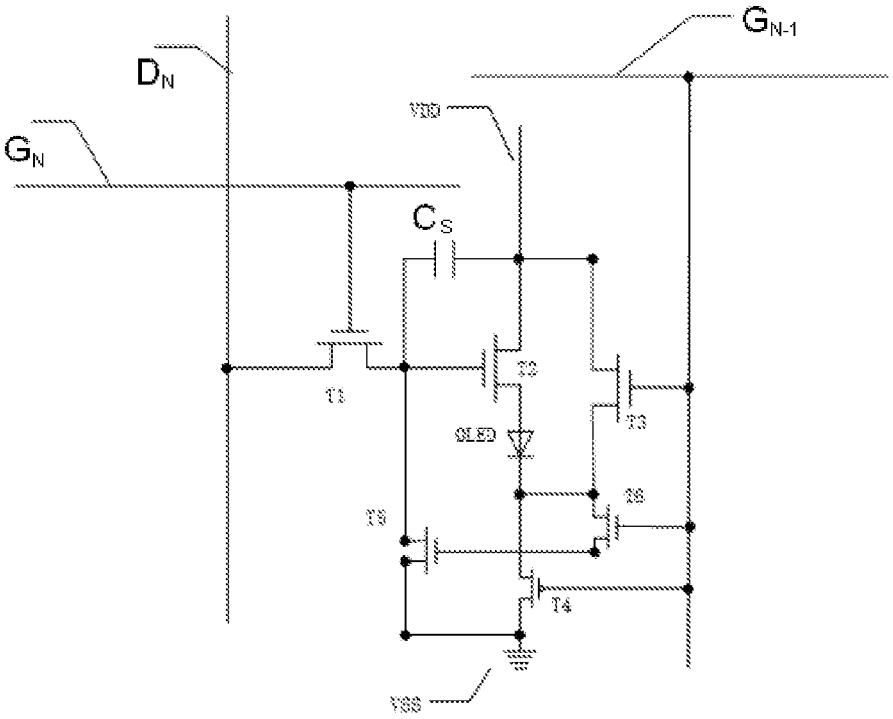
FIG. 5 is a schematic structural diagram of a pixel driving circuit according to still another embodiment of the present disclosure.
Figure 6:
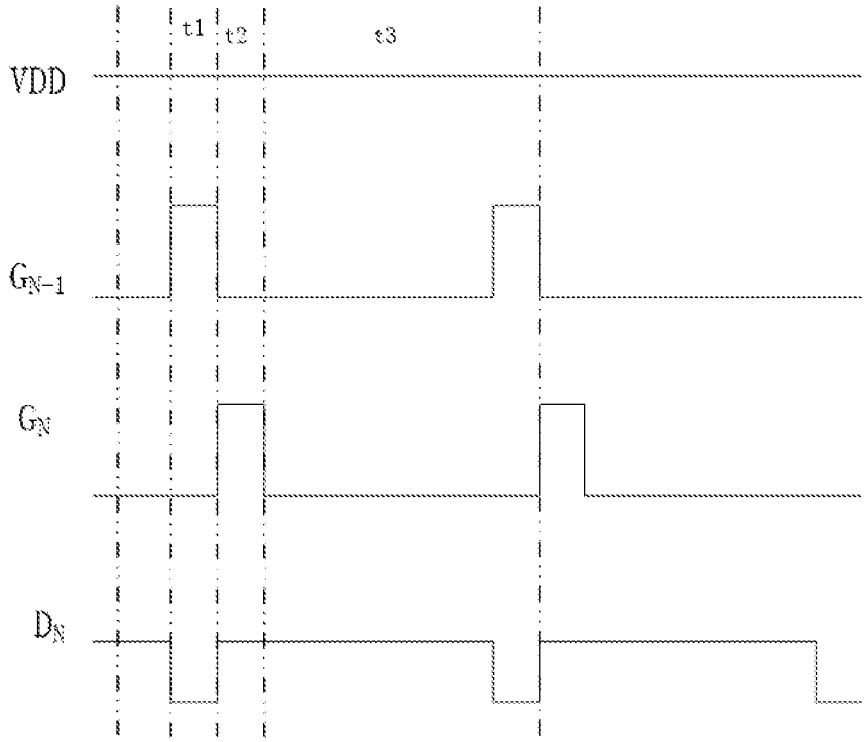
FIG. 6 is a signal timing diagram of a driving method for the pixel driving circuit illustrated in FIG. 5.

FIG. 5 illustrates structure of a pixel driving circuit provided according to an embodiment of the present disclosure, FIG. 6 illustrates a signal timing diagram of a driving method of the pixel driving circuit illustrated in FIG. 5. As illustrated in FIG. 5, the pixel driving circuit comprises a switching sub-circuit, a driving sub-circuit, a storage capacitor, a charge eliminating sub-circuit, and a gate voltage resetting sub-circuit, wherein the switching sub-circuit includes a first transistor T1, wherein the gate of the first transistor T1 serves as its control terminal, and is connected to the first scanning signal line (illustrated as the scanning signal line $G_N$ of the present row in the figure); the first electrode of the first transistor T1 serves as its first terminal, and the first electrode is connected to the data signal line (illustrated as the data signal line $D_N$ of the present row); the second electrode of the first transistor T1 serves as its second terminal, and the second electrode is connected to the gate of the second transistor T2;

the driving sub-circuit includes a second transistor T2, wherein the gate of the second transistor T2 serves as its control terminal and is connected to the second electrode of the first transistor T1; the first electrode of the second transistor T2 serves as its first terminal, and the first electrode is connected to the power supply voltage terminal VDD; the second electrode of the second transistor T2 serves as its second terminal, and the second electrode is connected to an anode of the organic light emitting element (illustrated as an organic light emitting diode OLED);

the charge eliminating sub-circuit includes a third transistor T3 and a fourth transistor T4; the gate of the third transistor T3 and the gate of the fourth transistor T4 serve as the control terminal of the charge eliminating sub-circuit and are both connected to the second scanning signal line (the scanning signal line $G_{N-1}$ of the previous row illustrated in the figure);

the first electrode of the third transistor T3 is connected to the first terminal of the driving transistor (the first electrode of the second transistor T2 illustrated in the figure), and the second electrode of the third transistor T3 is connected to the cathode of the organic light emitting element (the OLED illustrated in the figure);

the first electrode of the fourth transistor T4 is connected to the cathode of the organic light emitting element (the OLED illustrated in the figure), and the second electrode of the fourth transistor T4 is connected to the reference voltage terminal VSS;

the gate voltage resetting sub-circuit includes a fifth transistor T5 and a sixth transistor T6; the gate of the sixth transistor T6 serves as its control terminal, and the gate is connected to the third scanning signal line (the scanning signal line $G_{N-1}$ of the previous row illustrated in the figure), the first electrode of the sixth transistor T6 is connected to the cathode of the organic light emitting element (the OLED illustrated in the figure), and the second electrode of the sixth transistor T6 is connected to the gate of the fifth transistor T5;

the first electrode of the fifth transistor T5 is connected to the control terminal of the driving transistor T2, and the second electrode of the fifth transistor T5 is connected to the reference voltage terminal VSS.

In the above pixel driving circuit, for example, the first transistor, the second transistor, the third transistor, the fifth transistor and the sixth transistor are all N-type transistors, the fourth transistor is a P-type transistor, in such a case, the driving method of the pixel driving circuit is described below. Of course, the type of each of the above transistors may be set different as needed, and is not limited to the mode described in the embodiment.

The first electrode of each of said transistors is the drain or the source, and the second electrode is the other of the two, the drain or the source; that is, if the first electrode is the drain, then the second source is the source; and if the first electrode is the source, then the second electrode is the drain.

For example, the power supply voltage terminal VDD mentioned above is at a high potential, and the reference voltage terminal VSS is at a low potential, when the pixel driving circuit operates, it can operate in two operating periods.

As illustrated in FIG. 5 and FIG. 6, in the first operating period t1, the potential between the anode and the cathode of the OLED is reversed and the gate voltage of the driving transistor is reset; for example, the scanning signal line $G_{N-1}$ of the previous row outputs a scanning signal which is a high potential signal; while the scanning signal is supplied to the pixel cells of the previous row, the gates of the third transistor T3 and the sixth transistor T6 are at a high potential, so that the third transistor T3 and the sixth transistor T6 are turned on; meanwhile since the fourth transistor T4 is a P-type transistor, at this time, the fourth transistor T4 is turned off; since the third transistor T3 is turned on, the voltage of the power supply voltage terminal VDD is loaded to the cathode of the OLED via the third transistor T3; since the fourth transistor T4 is turned off, a path between the OLED and reference voltage terminal VSS is disconnected, so that the cathode of the OLED is at a high potential; the anode potential of the OLED is smaller than the cathode potential thereof, and the potential between the anode and the cathode of the OLED is reversed, eliminating most of the electrons and the holes gathered at the interface of the OLED, which avoids gathering and accumulation of holes and electrons at the above two interface locations.

Meanwhile, since the gate of the sixth transistor T6 is at a high potential, the sixth transistor T6 is turned on; the high potential at the cathode of the OLED is transmitted to the gate of the fifth transistor T5 via the second electrode of the sixth transistor T6, and thereby the fifth transistor T5 is turned on; the first electrode of the fifth transistor T5 is connected to the gate of the second transistor T2, and the second electrode of the fifth transistor T5 is connected to the reference voltage terminal VSS, so that the gate potential of the second transistor T2 is pulled down to the low potential at the reference voltage terminal VSS, thus resetting the gate voltage of the second transistor T2, and addressing the issue of the threshold voltage Vth drift of the second transistor T2.

The second operating period includes t2 and t3, and it is referred to as the OLED display period; in the period t2, the scanning signal outputted by the scanning signal line $G_{N-1}$ of the previous row is a low potential signal, and the scanning signal outputted by the scanning signal line $G_N$ of the present row is a high potential signal; at this time, the gate of the first transistor T1 is at a high potential, so that the first transistor T1 is turned on; and the data voltage $V_{data}$ of the data signal outputted by the data signal line $G_N$ of the present row is applied to the gate of the second transistor T2 and the storage capacitor $C_S$ through the first transistor T1, so that the data voltage $V_{data}$ is written to the storage capacitor $C_S$, and acts on the gate of the second transistor T2, so that the second transistor T2 is turned on, and the driving current outputted by the second transistor T2 drives the OLED to emit light.

In the period t3, the scanning signal outputted by the scanning signal line $G_N$ of the present row is a low potential signal, and the first transistor T1 is turned off, due to the storage function of the storage capacitor $C_S$, the gate voltage of the second transistor T2 can continue to be maintained at the data voltage $V_{data}$, thus causing the second transistor T2 to be in a turned-on state, and there is driving current entering the OLED to drive the OLED to emit light, until the scanning signal outputted from the scanning signal line $G_N$ of the present row in the next frame arrives, and then the first transistor T1 is turned on again.

As known from operations of the above pixel driving circuit, the pixel driving circuit reverses the potential between the anode and the cathode of the OLED and reset the gate voltage of the second transistor that serves as the driving transistor, through the scanning signal line of the previous row. Of course, if the types of the respective transistors are different, it is only required that according to the above working process, the corresponding control signals are outputted through the scanning signal lines based on the types of the transistors, thereby controlling the respective transistors to be turned on or off; for example, if the third transistor, the fifth transistor and the sixth transistor are P-type transistors, the fourth transistor is an N-type transistor, in this case, the scanning signal line of the previous row can output a low potential signal to control the third transistor, the fifth transistor and the sixth transistor to be turned on and the fourth transistor to be turned off. If the first transistor and the second transistor are P-type transistors, a low potential signal can be outputted by the scanning signal line of the present row so as to control the first transistor and the second transistor to be turned on, the driving method and working process of the pixel driving circuit are similar to those described above, no details will be repeated here.

The above description of the working process is described in a top-down order, and the process is divided into time period t1, time periods t2 and t3, but the present disclosure does not limit the order of the respective time periods, and the pixel driving circuit does not necessarily follow the above order of the respective time periods to drive and operate. For example, if scanning is performed in a bottom-up order, the second operating period, that is, periods t2 and t3, is performed first, and thereafter the first operating period, that is, period t1, is performed; if a time division driving mode is adopted, the first operating period may be performed first, then the second operating period is performed; or the second operating period may be performed first, then the first operating period is performed; regardless of which order is adopted, the working principle is the same as the description of the above embodiments, and the working process will not be described again.

Figure 8:
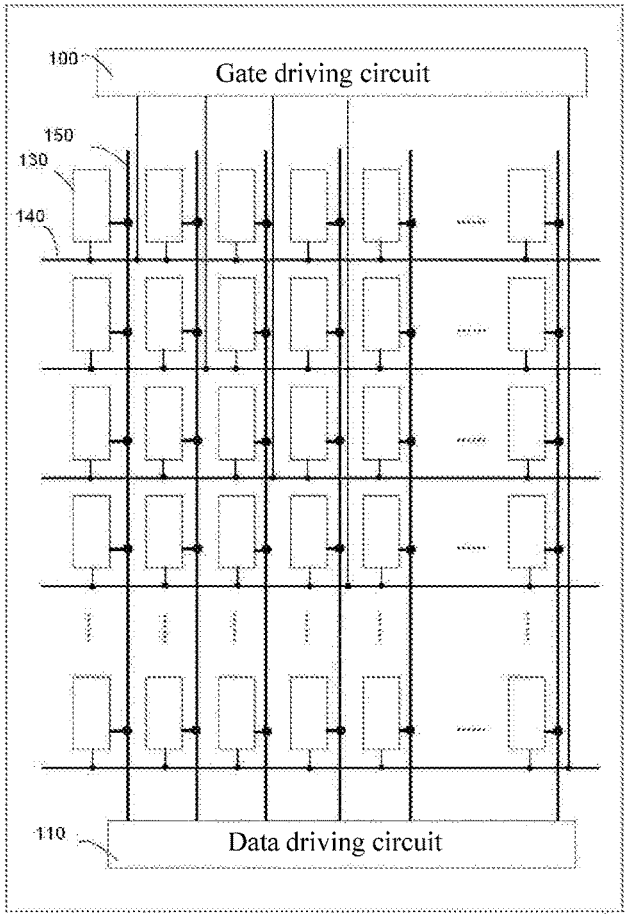
FIG. 8 is a schematic diagram of a display panel according to an embodiment of the present disclosure.

An embodiment of the present disclosure further provides an organic light emitting display panel; as illustrated in FIG. 8, said panel comprises a plurality of pixel cells 130, a plurality of scanning signal lines 140 and a plurality of data signal lines 150, wherein areas defined by intersection of the scanning signal lines and the data signal lines constitute the respective pixel cells 130, and each pixel cell includes an organic light emitting element and the pixel driving circuit as described in any of the above embodiments.

The organic light emitting display panel with the pixel driving circuit according to an embodiment of the present disclosure can eliminate most of the electrons gathered at the interface between the electron transport layer and the organic light emitting layer of the organic light emitting element and most of the holes gathered at the interface between the hole transport layer and the organic light emitting layer, avoid gathering and accumulation of holes and electrons at the aforesaid two interface locations, thereby addressing the issue of the rapid decrease of luminous efficiency resulted from the organic light emitting element being driven to emit light for a long time, enhancing the luminous efficiency, and increasing the life span of the organic light emitting element, improving the display effect when the organic light emitting display panel displays a picture.

Figure 7:
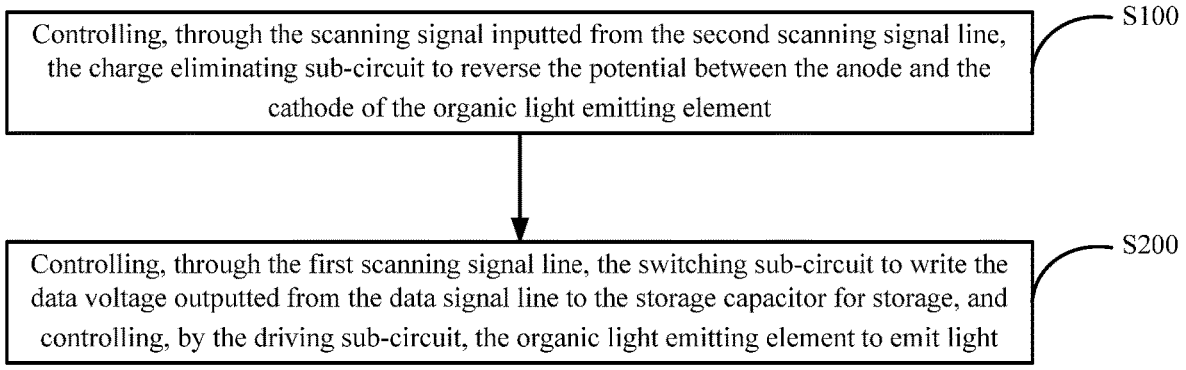
FIG. 7 is a flowchart of a pixel driving method according to an embodiment of the present disclosure.

An embodiment of the present disclosure further provides a driving method for a pixel circuit, which is applied to the pixel driving circuit described in any of the above embodiments. As illustrated in FIG. 7, the driving method includes:

controlling, through a scanning signal inputted from the first scanning signal line, the charge eliminating sub-circuit to reverse the potential between the anode and the cathode of the organic light emitting element; and controlling the switching sub-circuit, through a scanning signal inputted from the second scanning signal line, to write the data voltage outputted from the data signal line for the present row to the storage capacitor for storage, and controlling, by the driving sub-circuit, the organic light emitting element to emit light.

In an embodiment, the driving method further comprises:

controlling, through the first scanning signal line, the gate voltage resetting sub-circuit to reset the gate voltage of the driving sub-circuit.

The driving method of the pixel circuit provided according to an embodiment of the present disclosure is used to drive the pixel driving circuit in the above embodiment, which can address the issue of the rapid decrease of luminous efficiency resulted from the organic light emitting element being driven to emit light for a long time, enhancing the luminous efficiency, and increasing the life span of the organic light emitting element.

It should be noted that the above-mentioned connection refers to electrical connection, and an electrical signal can be transmitted between two terminals that are connected.

The present application is intended to cover any variations, usages or adaptive modifications of the present disclosure. These variations, usages or adaptive modifications follow the general principle of the present disclosure and include common knowledge or conventional technical means in the related art which are not disclosed in the present disclosure. The specification and embodiments are considered merely as illustrative, and the true scope of the present disclosure is specified by the following claims.

It should be understood that the present disclosure is not limited to the specific structures that have been described in the above and illustrated in the accompany drawings, various modifications and alterations may be made to the present disclosure without departing from the definition of the invention provided by the appended claims. The scope of the present disclosure is defined only by the attached claims.

What is claimed is:

1. A pixel driving circuit, comprising:

a switching sub-circuit having a control terminal connected to a first scanning signal line, a first terminal connected to a data signal line, and a second terminal connected to a control terminal of a driving sub-circuit, and configured to write a data voltage outputted by the data signal fine;

the driving sub-circuit having a first terminal connected to a power supply voltage terminal and a second terminal connected to an anode of an organic light emitting element, and configured to drive the organic light emitting element to emit fight under control of the switching sub-circuit;

a storage capacitor having one terminal connected to the control terminal of the driving sub-circuit and the other terminal connected to the first terminal of the driving sub-circuit, and configured to store the data voltage outputted by the data signal line; and a charge eliminating sub-circuit having a control terminal connected to a second scanning signal fine, and other terminals connected to the first terminal of the driving sub-circuit, a cathode of the organic light emitting element and a reference voltage terminal respectively, and configured to reverse a potential between the anode and the cathode of the organic fight emitting element under control of the second scanning signal line.

2. The pixel driving circuit according to claim 1. wherein the switching sub-circuit comprises a first transistor, wherein a gate of the first transistor serves as the control terminal of the switching sub-circuit, a first electrode of the first transistor serves as the first terminal of the switching sub-circuit, and a second electrode of the first transistor serves as the second terminal of the switching sub-circuit.

3. The pixel driving circuit according to claim 1, wherein the driving sub-circuit comprises a second transistor, wherein a gate of the second transistor serves as the control terminal of the driving sub-circuit, a first electrode of the second transistor serves as the first terminal of the driving sub-circuit, and a second electrode of the second transistor serves as the second terminal of the driving sub-circuit.

4. The pixel driving circuit according to a claim 1, wherein the charge eliminating sub-circuit comprises a third transistor and a fourth transistor, wherein a gate of the third transistor and a gate of the fourth transistor serve as the control terminal of the charge eliminating sub-circuit, and are connected to the second scanning signal line;

a first electrode of the third transistor is connected to the first terminal of the driving sub-circuit, and a second electrode of the third transistor is connected to the cathode of the organic light emitting element;

a first electrode of the fourth transistor is connected to the cathode of the organic light emitting element, and a second electrode of the fourth transistor is connected to the reference voltage terminal.

5. The pixel driving circuit according to claim 4, wherein one of the third transistor and the fourth transistor is of an N-type transistor, and the other of the third transistor and the fourth transistor is of a P-type transistor.

6. A method applied to the pixel driving circuit according to claim 1, the method comprising:

controlling, by the scanning signal inputted from the second scanning signal line, the charge eliminating sub-circuit to reverse the potential between the anode and the cathode of the organic light emitting element; and controlling, by the first scanning signal line, the switching sub-circuit to write the data voltage outputted from the data signal line to the storage capacitor for storage, and controlling, by the driving sub-circuit, the organic light emitting element to emit light.

7. The method according to claim 6, further comprising:

controlling, by the third scanning signal line, the gate voltage resetting sub-circuit to reset the gate voltage of the driving sub-circuit.

8. The pixel driving circuit according to claim 1, further comprising:

a gate voltage resetting sub-circuit having a control terminal connected to a third scanning signal line, and other terminals connected to the cathode of the organic light emitting element, the control terminal of the driving sub-circuit and the reference voltage terminal respectively, and configured to reset a gate voltage of the driving sub-circuit under control of the third scanning signal line.

9. The pixel driving circuit according to claim 2, wherein the first scanning signal line is a scanning signal line for a present row, the second scanning signal line and the third scanning signal line are both a scanning signal line for a previous row.

10. The pixel driving circuit according to claim 8, wherein the gate voltage resetting sub-circuit comprises a fifth transistor and a sixth transistor;

a gate of the sixth transistor serves as the control terminal of the gate voltage resetting sub-circuit, a first electrode of the sixth transistor is connected to the cathode of the organic light emitting element, and a second electrode of the sixth transistor is connected to a gate of the fifth transistor;

a first electrode of the fifth transistor is connected to the control terminal of the driving sub-circuit, and a second electrode of the fifth transistor is connected to the reference voltage terminal.

11. The pixel driving circuit according to claim 10, wherein the fifth transistor and the sixth transistor are both of N-type transistors or both of P-type transistors.

12. An organic light emitting display panel, comprising a plurality of pixel cells, a plurality of scanning signal lines and a plurality of data signal lines, wherein respective pixel cells are arranged in areas defined by intersection of the scanning signal lines and the data signal lines, each pixel cell includes an organic light emitting element and the pixel driving circuit according to any claim 1.

13. The organic light emitting display panel according to claim 12, wherein the switching sub-circuit comprises a first transistor, wherein a gate of the first transistor serves as the control terminal of the switching sub-circuit, a first electrode of the first transistor serves as the first terminal of the switching sub-circuit, and a second electrode of the first transistor serves as the second terminal of the switching sub-circuit.

14. The organic light emitting display pan& according to claim 12, wherein the driving sub-circuit comprises a second transistor, wherein a gate of the second transistor serves as the control terminal of the driving sub-circuit, a first electrode of the second transistor serves as the first terminal of the driving sub-circuit, and a second electrode of the second transistor serves as the second terminal of the driving sub-circuit.

15. The organic light emitting display panel according to claim 12, wherein the charge eliminating sub-circuit comprises a third transistor and a fourth transistor, wherein a gate of the third transistor and a gate of the fourth transistor serve as the control terminal of the charge eliminating sub-circuit, and are connected to the second scanning signal line;

a first electrode of the third transistor is connected to the first terminal of the driving sub-circuit, and a second electrode of the third transistor is connected to the cathode of the organic light emitting element;

a first electrode of the fourth transistor is connected to the cathode of the organic light emitting element, and a second electrode of the fourth transistor is connected to the reference voltage terminal.

16. The organic light emitting display panel according to claim 12, wherein the pixel driving circuit further comprise:

a gate voltage resetting sub-circuit having a control terminal connected to a third scanning signal line, and other terminals connected to the cathode of the organic light emitting element, the control terminal of the driving sub-circuit and the reference voltage terminal respectively, and configured to reset a gate voltage of the driving sub-circuit under control of the third scanning signal line.

17. The organic light emitting display panel according to claim 16, wherein the first scanning signal line is a scanning signal line for a present row, the second scanning signal line and the third scanning signal line are both a scanning signal line for a previous row.

18. The organic light emitting display panel according to claim 16, wherein the gate voltage resetting sub-circuit comprises a fifth transistor and a sixth transistor;

a gate of the sixth transistor serves as the control terminal of the gate voltage resetting sub-circuit, a first electrode of the sixth transistor is connected to the cathode of the organic light omitting element, and a second electrode of the sixth transistor is connected to a gate of the fifth transistor;

a first electrode of the fifth transistor is connected to the control terminal of the driving sub-circuit, and a second electrode of the fifth transistor is connected to the reference voltage terminal.

* * * * *